US007708453B2

(12) United States Patent
Kozyuk

(10) Patent No.: US 7,708,453 B2
(45) Date of Patent: May 4, 2010

(54) DEVICE FOR CREATING HYDRODYNAMIC CAVITATION IN FLUIDS

(75) Inventor: Oleg V. Kozyuk, North Ridgeville, OH (US)

(73) Assignee: Cavitech Holdings, LLC, Independence, OH (US)

( * ) Notice: Subject to any disclaimer, the term of this patent is extended or adjusted under 35 U.S.C. 154(b) by 1097 days.

(21) Appl. No.: 11/368,274

(22) Filed: Mar. 3, 2006

(65) Prior Publication Data

US 2007/0205307 A1 Sep. 6, 2007

(51) Int. Cl.
*B01F 5/06* (2006.01)

(52) U.S. Cl. ..... 366/337; 366/340; 138/42

(58) Field of Classification Search ..... 366/178.1, 366/181.5, 336–338, 340; 48/181.5; 138/37, 138/40, 42
See application file for complete search history.

(56) References Cited

U.S. PATENT DOCUMENTS 1,110,715 A * 9/1914 Reese ..... 4/255.09
1,246,583 A * 11/1917 Fulweiler ..... 138/38
1,790,854 A * 2/1931 Defrance et al. ..... 48/189.4
3,051,452 A * 8/1962 Nobel ..... 366/337
3,167,305 A * 1/1965 Backx et al. ..... 366/338
4,208,136 A * 6/1980 King ..... 366/338
5,309,946 A * 5/1994 Ligneul ..... 138/39
5,423,608 A * 6/1995 Chyou et al. ..... 366/337
5,810,052 A 9/1998 Kozyuk
5,931,777 A 8/1999 Kozyuk
5,937,906 A 8/1999 Kozyuk
5,969,207 A 10/1999 Kozyuk
5,971,601 A 10/1999 Kozyuk
6,012,492 A 1/2000 Kozyuk
6,035,897 A 3/2000 Kozyuk
6,365,555 B1 4/2002 Moser et al.
6,502,979 B1 1/2003 Kozyuk
6,589,501 B2 7/2003 Moser et al.
6,802,639 B2 10/2004 Kozyuk
6,869,586 B1 3/2005 Moser et al.
7,041,144 B2 5/2006 Kozyuk
7,086,777 B2 8/2006 Kozyuk
7,207,712 B2 4/2007 Kozyuk
7,449,159 B2 * 11/2008 Nomura et al. ..... 422/224
7,507,387 B2 * 3/2009 Mae et al. ..... 422/224
2006/0027100 A1 2/2006 Kozyuk
2006/0050608 A1 3/2006 Kozyuk
2006/0118034 A1 6/2006 Kozyuk
2006/0137598 A1 6/2006 Kozyuk et al.

* cited by examiner

*Primary Examiner*—David L Sorkin
(74) *Attorney, Agent, or Firm*—Benesch, Friedlander Coplan & Aronoff LLP

(57) ABSTRACT

A device and method for creating hydrodynamic cavitation in fluid is provided. The device includes a fluid passage having at least two local constrictions of flow provided in a parallel relationship therein, wherein each local constriction of flow configured to generate a hydrodynamic cavitation field downstream therefrom. The at least two local constrictions of flow can include concentrically arranged annular orifices.

18 Claims, 3 Drawing Sheets

DEVICE FOR CREATING HYDRODYNAMIC CAVITATION IN FLUIDS

BACKGROUND OF THE INVENTION

One of the most promising courses for further technological development in chemical, pharmaceutical, cosmetic, refining, food products, and many other areas relates to the production of emulsions and dispersions having the smallest possible particle sizes and maximum size uniformity. Moreover, during the creation of new products and formulations, the challenge often involves the production of two, three, or more complex components in disperse systems containing particle sizes at the submicron level. Given the ever-increasing requirements placed on the quality of dispersion, traditional methods of dispersion that have been used for decades in technological processes have reached their limits. Attempts to overcome these limits by mere manipulation of these traditional technologies are often not effective.

Hydrodynamic cavitation is widely known as a method used to obtain free disperse systems, particularly lyosols, diluted suspensions, and emulsions. Such free disperse systems are fluidic systems wherein dispersed phase particles have no contacts, participate in random beat motion, and freely move by gravity. Such dispersion and emulsification effects are accomplished within the fluid flow due to cavitation effects produced by a change in geometry of the fluid flow.

The boiling point of a liquid is defined as the temperature at which the vapor pressure of the liquid is equal to the pressure of the atmosphere on the liquid. For pure compounds, the normal boiling point is defined as the boiling point at one standard atmosphere of pressure on the liquid. If the pressure on the liquid is reduced from one standard atmosphere, the boiling point observed for the compound is likewise reduced from that estimated for the pure compound.

Hydrodynamic cavitation is the formation of cavities and cavitation bubbles filled with a vapor-gas mixture inside the fluid flow or at the boundary of the baffle body resulting from a local pressure drop on the fluid. If during the process of movement of the fluid, the pressure decreases to a magnitude under which the fluid reaches its boiling point for the given temperature, then a great number of vapor-filled cavities and bubbles are formed. Insofar as the vapor-filled bubbles and cavities move together with the fluid flow, these bubbles and cavities may move into an elevated pressure zone. When these bubbles and cavities enter a zone having increased pressure, vapor condensation takes place within the cavities and bubbles, causing the cavities and bubbles to collapse almost instantaneously, which creates very large pressure impulses. The magnitude of the pressure impulses within the collapsing cavities and bubbles may reach 150,000 psi. The result of these high-pressure implosions is the formation of shock waves that emanate from the point of each collapsed bubble. Such high-impact loads result in the breakup of any medium found near the collapsing bubbles.

A dispersion process takes place when, during cavitation, the collapse of a cavitation bubble near the boundary of the phase separation of a solid particle suspended in a liquid results in the breakup of the suspension particle. An emulsification and homogenization process takes place when, during cavitation, the collapse of a cavitation bubble near the boundary of the phase separation of a liquid suspended or mixed with another liquid results in the breakup of drops of the disperse phase. Thus, the use of kinetic energy from collapsing cavitation bubbles and cavities, produced by hydrodynamic means, can be used for various mixing, emulsifying, homogenizing, and dispersing processes.

SUMMARY

A device for creating hydrodynamic cavitation in fluid is provided. The device includes a fluid passage having at least two local constrictions of flow provided in a parallel relationship therein, wherein each local constriction of flow configured to generate a hydrodynamic cavitation field downstream therefrom.

A method of creating hydrodynamic cavitation in fluid is also provided. The method includes the steps of providing a fluid passage having at least two local constrictions of flow provided in a parallel relationship therein and passing the fluid at a sufficient velocity through the at least two local constrictions of flow to generate a hydrodynamic cavitation field downstream from each local constriction.

BRIEF DESCRIPTION OF THE DRAWINGS

It will be appreciated that the illustrated boundaries of elements (e.g., boxes or groups of boxes) in the figures represent one example of the boundaries. One of ordinary skill in the art will appreciate that one element may be designed as multiple elements or that multiple elements may be designed as one element. An element shown as an internal component of another element may be implemented as an external component and vice versa.

Further, in the accompanying drawings and description that follow, like parts are indicated throughout the drawings and description with the same reference numerals, respectively. The figures are not drawn to scale and the proportions of certain parts have been exaggerated for convenience of illustration.

DETAILED DESCRIPTION

Figure 1:
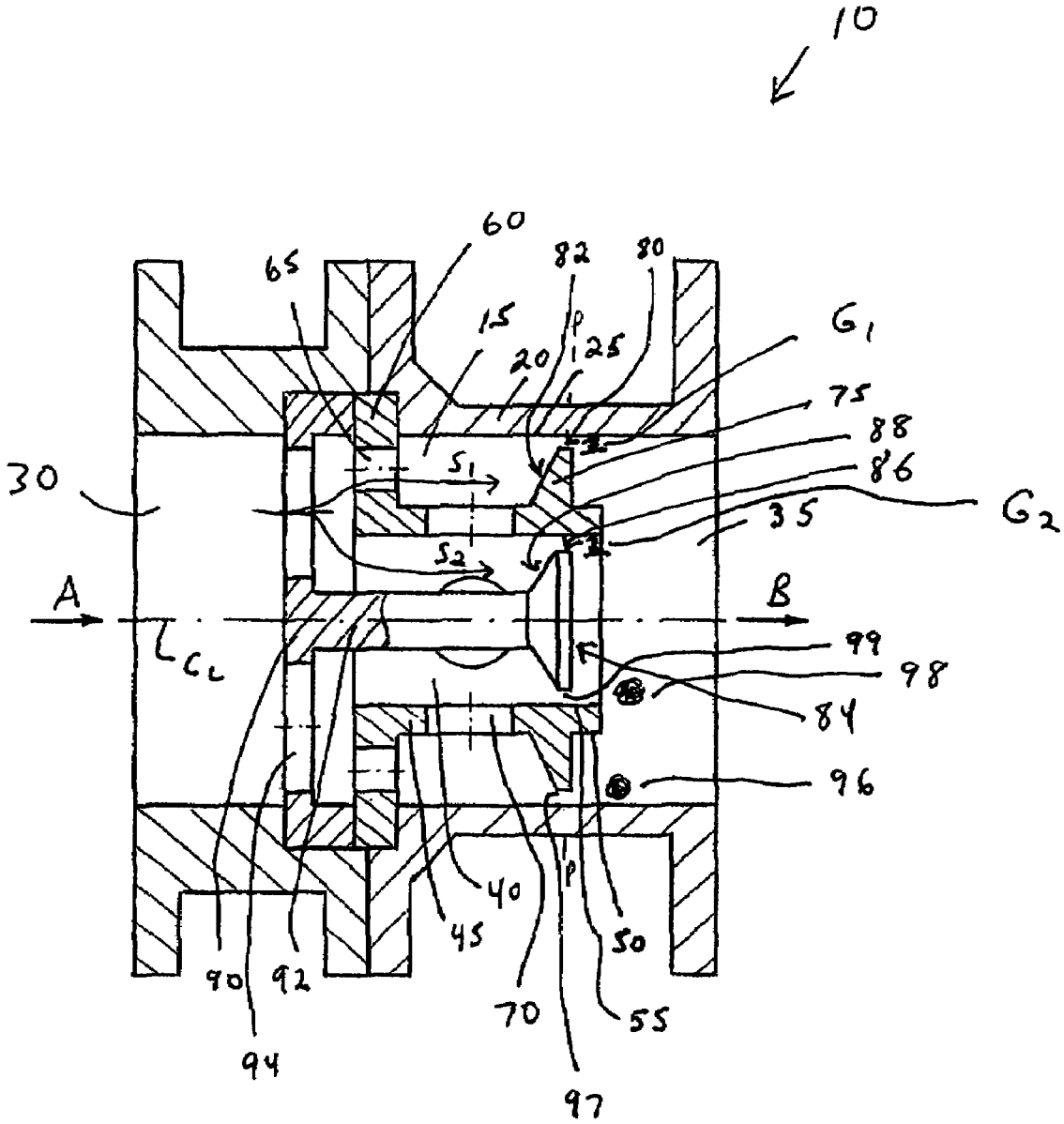
FIG. 1 illustrates a longitudinal cross-sectional view of one embodiment of a device 10 for generating hydrodynamic cavitation in a fluid.

FIG. 1 illustrates a longitudinal cross-sectional view of one embodiment of a device 10 for generating hydrodynamic cavitation in a fluid. The device 10 includes a first fluid passage or channel 15 having a longitudinal axis or centerline $C_L$. The fluid passage 15 is defined by a wall 20 having an inner surface 25. In the illustrated embodiment, the wall 20 is a cylindrical wall that defines a fluid passage having a circular cross-section. In alternative embodiments (not shown), the cross-section of the fluid passage 25 may take the form of other geometric shapes such as triangular, square, rectangular, pentagonal, hexagonal, or any other shape. In these alternative embodiments or the illustrated embodiment, the first fluid passage 15 may be defined by multiple walls or wall segments. For example, a fluid passage having a square cross-section is defined by four walls or wall segments.

As shown in FIG. 1, the first fluid passage 15 can further include an inlet 30 configured to introduce a fluid into the device 10 along a path represented by arrow A and an outlet 35 configured to permit the fluid to exit the device 10.

With further reference to FIG. 1, the device 10 further includes a second fluid passage 40 disposed within the first fluid passage 15. The second fluid passage 40 is defined by a wall 45 having an outer surface 50 and an inner surface 55. In the illustrated embodiment, the wall 45 is a cylindrical wall that defines a second fluid passage having a circular cross-section. In alternative embodiments (not shown), the cross-section of the second fluid passage 40 may take the form of other geometric shapes such as triangular, square, rectangular, pentagonal, hexagonal, or any other shape. In these alternative embodiments or the illustrated embodiment, the second fluid passage 40 may be defined by multiple walls or wall segments. For example, a second fluid passage can have a triangular cross-section is defined by three walls or wall segments.

In this embodiment, the second fluid passage 40 is disposed coaxially within the first fluid passage 15 such that it shares the same centerline $C_L$. Of course, it is possible that the second fluid passage 40 may not be disposed coaxially within the fluid passage 15.

To retain the wall 45 that defines the second fluid passage 40 within the first fluid passage 15, the wall 45 is connected or made integral with a plate 60 that is mounted to the wall 20 with screws or other attachment means. In the illustrated embodiment, the plate 60 is embodied as a disk when the fluid passage 15 has a circular cross-section, or the plate 60 can be embodied in a variety of shapes and configurations that can match the cross-section of the first fluid passage 15. The plate 60 includes one or more orifices 65 configured to permit fluid to pass therethrough. In alternative embodiments (not shown), a crosshead, post, propeller or any other structure that produces a minor loss of fluid pressure can be used to attach the wall 45, which defines the second fluid passage 40, to the wall 20, which defines the first fluid passage 15, instead of the plate 60 having orifices 65.

The second fluid passage 40 is configured to divide the fluid flow in the device 10 into two primary streams—first stream $S_1$ and second stream $S_2$. In this embodiment, the first stream $S_1$ flows between the outer surface 50 of the second fluid passage 40 and the inner surface of the first fluid passage 15, while the second stream $S_2$ flows within the second fluid passage 40.

Optionally, the wall 45 that defines the second fluid passage 40 may include orifices that provide fluid communication between the first stream $S_1$ and the second stream $S_2$ to assist in equalizing the flow rate between the first stream $S_1$ and the second stream $S_2$. In the illustrated embodiment, the wall 45 that defines the second fluid passage 40 includes four orifices 70. In alternative embodiments (not shown), the wall 45 that defines the second fluid passage 40 may include less than four orifices or more than four orifices. In the illustrated embodiment, the four orifices 70 have a circular cross-section. However, in alternative embodiments (not shown), one or more of the orifices 70 may take the form of another shape such as oval (e.g., a slot), triangular, square, rectangular, pentagonal, hexagonal, or any other geometric shape. In addition, the orifices 70 may be slotted or meshed. The dimensions of the orifices 70 may be such that the orifices 70 are sufficiently sized to equalize the flow rate, while not reducing the flow rate below a velocity that is conducive to generating hydrodynamic cavitation.

With further reference to FIG. 1, the wall 45, which defines the second fluid passage 40 includes a projection 75 that extends radially outward therefrom, but spaced from the inner surface 25 of the wall 20, which defines the first fluid stream $S_1$. The projection 75 is configured to partially restrict fluid flow of the first fluid passage 15 and is hereinafter referred to as first baffle 75. In the illustrated embodiment, the first baffle 75 includes a cylindrical portion 80 and a tapered portion 82 that confronts the fluid flow.

In the illustrated embodiment, the device 10 further includes a second baffle 84 disposed within the second fluid passage 40, but spaced from the inner surface 55 of the wall 45, which defines the second fluid passage 40. The second baffle 84 includes a cylindrical portion 86 and a tapered portion 88 that confronts the fluid flow.

In this embodiment, the second baffle 84 is disposed coaxially within the second fluid passage 40 such that it shares the same center line $C_L$. Of course, it is possible that the second baffle 84 may not be disposed coaxially within the second fluid passage 40.

To retain the second baffle 84 within the second fluid passage 40, the second baffle 84 is connected to a plate 90 via a shaft 92. In alternative embodiments (not shown), the plate 90 can be embodied as a disk when the first fluid passage 15 has a circular cross-section, or the plate 90 can be embodied in a variety of shapes and configurations that correspond to the cross-section of the first fluid passage 15. The plate 60 is mounted to the wall 20 with screws or other attachment means. The plate 90 includes a plurality of orifices 94 configured to permit fluid to pass therethrough. In alternative embodiments (not shown), a crosshead, post, propeller or any other structure that produces a minor loss of fluid pressure can be used to attach the second baffle 84 to the wall 20, instead of the plate 90 having orifices 94.

In the illustrated embodiment, the first baffle 75 is configured to generate a first hydrodynamic cavitation field 96 downstream therefrom via a first local constriction 97 of fluid flow formed between the outer surface of the cylindrical portion 80 of the first baffle 75 and the inner surface 25 of the wall 20. Similarly, the second baffle 84 is configured to generate a second hydrodynamic cavitation field 98 downstream therefrom via a second local constriction 99 of fluid flow formed between the outer surface of the cylindrical portion 86 of the second baffle 84 and the inner surface 55 of the wall 45. Since the first fluid passage 15 has a circular cross-section in the illustrated embodiment, the first and second local constrictions 96, 98 of flow are characterized as first and second annular orifices, respectively. However, it will be appreciated that if the cross-section of the first fluid passage 15 is any geometric shape other than circular, then each respective local constriction of flow may not be annular in shape. Likewise, if a baffle is not circular in cross-section, then each of the local constrictions of flow may not be annular in shape.

In the illustrated embodiment, the first local constriction 96 is defined by a first gap having a thickness $G_1$, which is the space between the outer surface of the cylindrical portion 80 of the first baffle 75 and the inner surface 25 of the wall 20. Similarly, the second local constriction 98 is defined by a second gap having a thickness $G_2$, which is the space between the outer surface of the cylindrical portion 86 of the second baffle 84 and the inner surface 55 of the wall 45. As shown in FIG. 1, the first gap thickness $G_1$ is substantially equal to the second gap thickness $G_2$. In alternative embodiments (not shown), the first gap thickness $G_1$ may be different than the second gap thickness $G_2$. A change in gap thickness can cause a change in flow rate and bubble size. However, the change in gap thickness does not affect the pressure drop in the device 10, nor does it change the velocity of the fluid passing through the local constrictions of flow.

The gap thickness of each local constriction 96, 98, or any local constriction of fluid flow discussed herein, is sufficiently dimensioned to increase the velocity of the fluid flow to a minimum velocity necessary to achieve hydrodynamic cavitation (hereafter the "minimum cavitation velocity"), which is dictated by the physical properties of the fluid being processed (e.g., viscosity, temperature, etc.). For example, the size of each local constriction 96, 98, or any local constriction of fluid flow discussed herein, can be dimensioned in such a manner so that the cross-section area of each local constriction of fluid flow would be at most about 0.6 times the diameter or major diameter of the cross-section of the fluid passage. The minimum cavitation velocity of a fluid is about 12 m/sec. On average, and for most hydrodynamic fluids, the minimum cavitation velocity is about 18 m/sec.

To vary the degree and character of the cavitation fields generated downstream from each of the baffles, one or both of the baffles 75, 84, or any baffle discussed herein, can be embodied in a variety of different shapes and configurations other than the ones described above. For example, the first and second baffles 75, 84, or any baffle discussed herein, can be embodied in the shapes and configurations disclosed in FIGS. 3a-3f of U.S. Pat. No. 6,035,897, the disclosure of which is hereby incorporated by reference in its entirety herein. Furthermore, it will be appreciated that other types of cavitation generators may be used instead of baffles.

In the illustrated embodiment, the first and second local constrictions 96, 98 are both aligned in a plane P, which is oriented substantially perpendicular to a plane passing through the centerline $C_L$. Additionally, the first and second local constrictions 96, 98 are provided in a concentric relationship with each other. However, it is possible that the first and second local constrictions 96, 98 may be positioned such that they are not aligned in the same plane or provided in a concentric relationship with each other. In effect, the device 10 includes two local constrictions of fluid flow that are provided in a parallel relationship with respect to each other.

Figure 2:
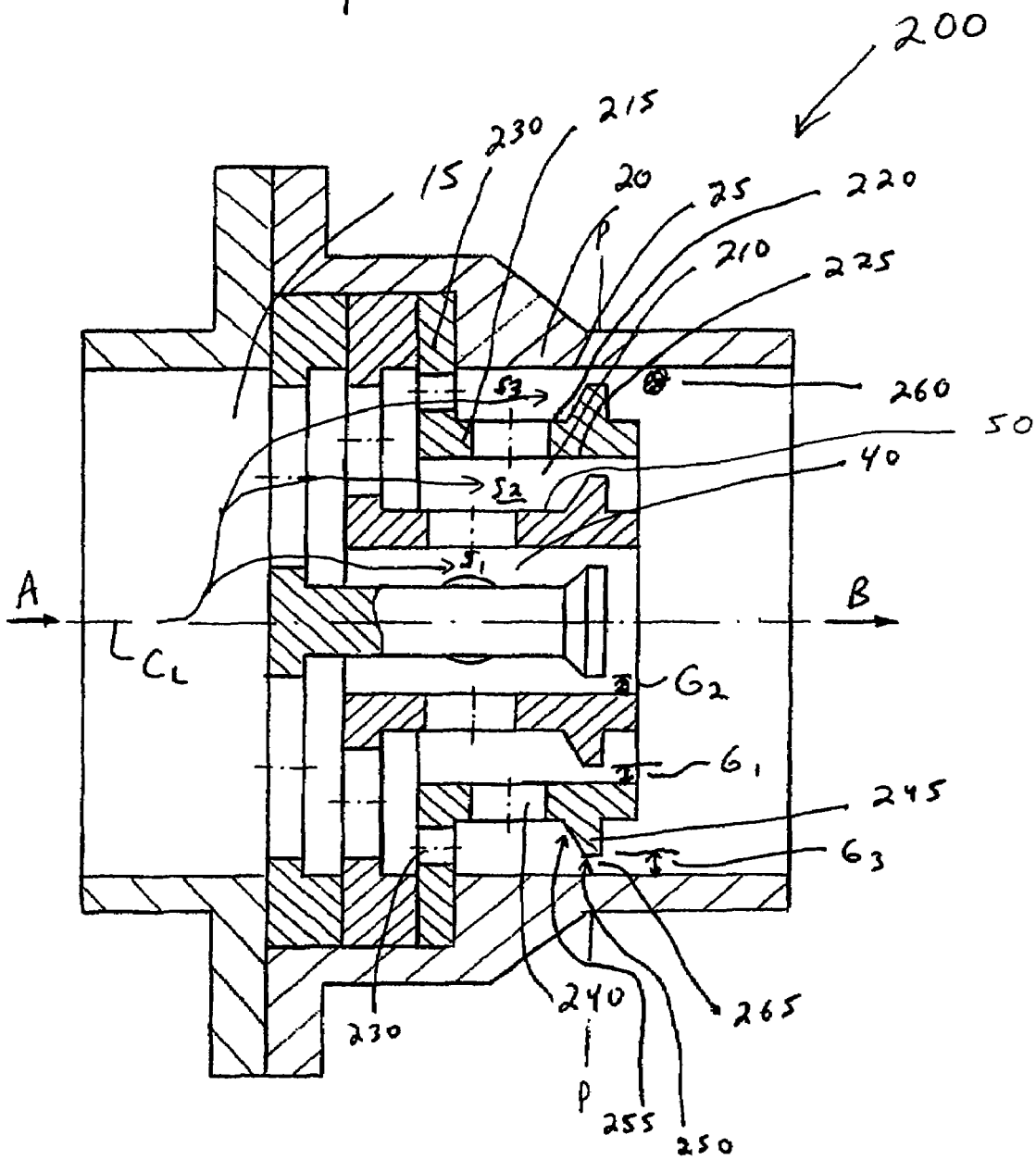
FIG. 2 illustrates a longitudinal cross-sectional view of an alternative embodiment of a device 200 for generating hydrodynamic cavitation in a fluid.

FIG. 2 illustrates a longitudinal cross-sectional view of an alternative embodiment of a device 200 for generating hydrodynamic cavitation in a fluid. The device 200 is similar to the device 10 illustrated in FIG. 1 and described above, except that it includes another fluid passage 210 (hereinafter referred to as the "third fluid passage 210") disposed within the first fluid passage 15 between the wall 20, which defines the first fluid passage 15, and the wall 45, which defines the second fluid passage 40. The third fluid passage 210 is defined by a wall 215 having an outer surface 220 and an inner surface 225.

In this embodiment, the third fluid passage 210 is disposed coaxially within the first fluid passage 15 such that it shares the same longitudinal axis or centerline $C_L$. Of course, it is possible that the third fluid passage 210 may not be disposed coaxially within the first fluid passage 15.

To retain the wall 215 that defines the third fluid passage 210 within the first fluid passage 15, the wall 215 is connected to or integral with a plate 230 that is mounted to the wall 20 with screws or other attachment means. In the illustrated embodiment, the plate 230 is embodied as a disk when the first fluid passage 15 has a circular cross-section, or the plate 230 can be embodied in a variety of shapes and configurations that can match the cross-section of the first fluid passage 15. The plate 230 includes one or more orifices 235 configured to permit fluid to pass therethrough. In alternative embodiments (not shown), instead of the plate 230 having orifices 235, a crosshead, post, propeller or any other structure that produces a minor loss of fluid pressure can be attached to the wall 215, which defines the second fluid passage 210, or to the wall 20, which defines the fluid passage 15.

The third fluid passage 210 is configured to divide the fluid flow in the device 200 into three primary streams—first stream $S_1$, second stream $S_2$, and third stream $S_3$. In this embodiment, the first stream $S_1$ flows within the second fluid passage 40, the second stream $S_2$ flows between the inner surface 225 of the third fluid passage 210 and the outer surface 50 of the second fluid passage 40, and the third stream $S_3$ flows between the outer surface 220 of the third fluid passage 210 and the inner surface 25 of the first fluid passage 15.

Optionally, the wall 215, which defines the third fluid passage 210, may include orifices similar to the ones described above to provide fluid communication between the first stream $S_1$ and the second stream $S_2$ and to assist in equalizing the flow rate between the first stream $S_1$ and the second stream $S_2$. In the illustrated embodiment, the wall 215 includes several orifices 240. The orifices 240 can be sufficiently sized to equalize the flow rate, while not reducing the flow rate below a velocity that is conducive to generating hydrodynamic cavitation.

With further reference to FIG. 2, the wall 215 includes a projection 245 that extends radially outward therefrom, but spaced from the inner surface 25 of the wall 20, which defines the first fluid passage 15. The projection 245 is configured to partially restrict the fluid flow of the third stream $S_3$ and is hereinafter referred to as "third baffle 245." In the illustrated embodiment, the third baffle 245 includes a cylindrical portion 250 and a tapered portion 255 that confronts the fluid flow.

In this embodiment, the third baffle 245 is configured to generate a third hydrodynamic cavitation field 260 downstream therefrom via a third local constriction 265 of fluid flow formed between the outer surface of the cylindrical portion 250 of the third baffle 245 and the inner surface 25 of the wall 20, which defines the first fluid passage 15. Since the first fluid passage 15 has a circular cross-section in the illustrated embodiment, the third local constriction 265 of flow is characterized as a third annular orifice. However, it will be appreciated that if the cross-section of the first fluid passage 15 is any geometric shape other than circular, then each respective local constriction of flow may not be annular in shape. Likewise, if a baffle is not circular in cross-section, then each of the local constrictions of flow may not be annular in shape.

In the illustrated embodiment, the third local constriction 265 is defined by a gap having a thickness $G_3$, which is the space between the outer surface of the cylindrical portion 255 of the third baffle 250 and the inner surface 25 of the wall 20. As shown in FIG. 2, the first, second, and third gap thicknesses $G_1$, $G_2$, $G_3$ are substantially equal to each other. In alternative embodiments (not shown), one or more of the gap thicknesses may differ from each other.

In the illustrated embodiment, the first, second, and third local constrictions 96, 98, 260 are all aligned in a plane P, which is oriented substantially perpendicular to a plane passing through the centerline $C_L$. Additionally, the first and second local constrictions 96, 98, 260 are provided in a concentric relationship with each other. However, it is possible that the first, second, and third local constrictions 96, 98, 260 may be positioned such that they are not aligned in the same plane or provided in a concentric relationship with each other.

In effect, the device 200 includes three local constrictions of fluid flow (e.g., annular orifices in this case) that are provided in a parallel relationship with respect to each other, which can maximize the amount of processing area for a given gap thickness. In alternative embodiments (not shown), the device 200 described above and illustrated in FIG. 1 can be modified to include three or more fluid passages having baffles provided thereon, thereby creating four or more local constrictions of flow within one fluid passage in a parallel relationship.

Figure 3:
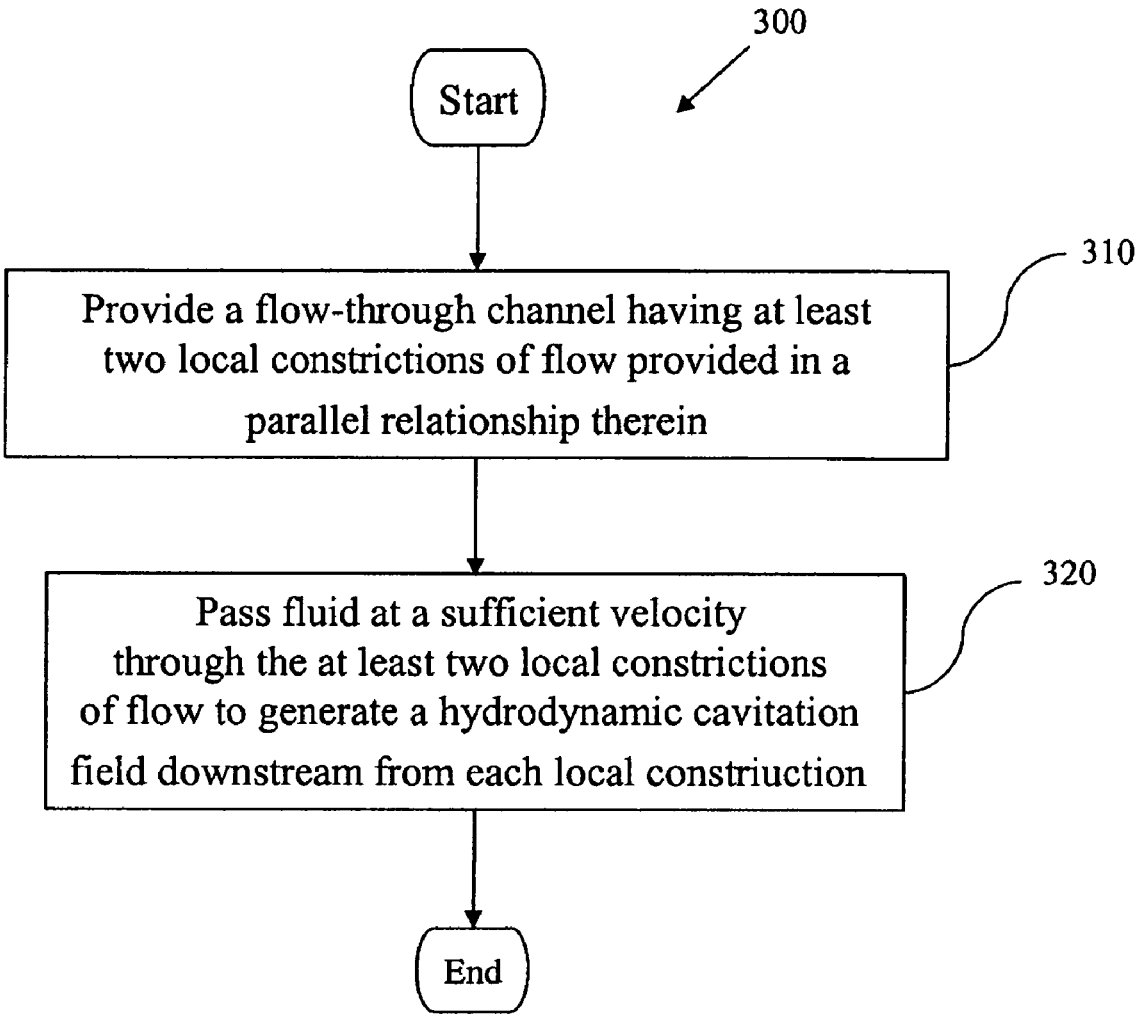
FIG. 3 illustrates one embodiment of a methodology for generating hydrodynamic cavitation in a fluid.

Illustrated in FIG. 3 is one embodiment of a methodology associated with generating one or more stages of hydrodynamic cavitation in a fluid. The illustrated elements denote "processing blocks" and represent functions and/or actions taken for generating one or more stages of hydrodynamic cavitation. In one embodiment, the processing blocks may represent computer software instructions or groups of instructions that cause a computer or processor to perform the processing. It will be appreciated that the methodology may involve dynamic and flexible processes such that the illustrated blocks can be performed in other sequences different that the one shown and/or blocks may be combined or separated into multiple components. The foregoing applies to all methodologies described herein.

With reference to FIG. 3, the process 300 involves a hydrodynamic cavitation process. The process 300 includes providing a fluid passage having at least two local constrictions of flow provided in a parallel relationship therein (block 310) and passing the fluid at a sufficient velocity through the at least two local constrictions of flow to generate a hydrodynamic cavitation field downstream from each local constriction (block 320).

In practice, a practitioner may establish a particular set of conditions and/or factors that facilitate cavitation bubble formation and fluid mixing by empirically varying some or all of the factors that affect formation of cavitation bubbles and mixing of fluids. This establishment and optimization of conditions may be facilitated by use of the methods and devices described herein on a small scale. Once optimum conditions are established, the practitioner may desire to scale-up or increase the volume of fluids that can be processed by the methods and devices described herein. In one example, the practitioner may increase the number of second fluid passages provided in the fluid passage, thereby increasing the number of local constrictions of flow provided in a parallel arrangement. At times, the overall diameter of the outer most fluid passage can be increased to accommodate an increased number of second fluid passages. Under either scenario, the overall processing area increases, while the gap thicknesses of the local constrictions of flow remain the same. Therefore, high volumes of fluid can be processed with the same or similar quality as low volumes.

To the extent that the term "includes" or "including" is employed in the detailed description or the claims, it is intended to be inclusive in a manner similar to the term "comprising" as that term is interpreted when employed as a transitional word in a claim. Furthermore, to the extent that the term "or" is employed in the detailed description or claims (e.g., A or B) it is intended to mean "A or B or both". When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto." Furthermore, to the extent the term "connect" is used in the specification or claims, it is intended to mean not only "directly connected to," but also "indirectly connected to" such as connected through another component or components.

While example devices, methods, and so on have been illustrated by describing examples, and while the examples have been described in considerable detail, it is not the intention of the applicant to restrict or in any way limit the scope of the appended claims to such detail. It is, of course, not possible to describe every conceivable combination of components or methodologies for purposes of describing the devices, methods, and so on described herein. Additional advantages and modifications will readily appear to those skilled in the art. Therefore, the invention is not limited to the specific details, the representative devices, and illustrative examples shown and described. Thus, this application is intended to embrace alterations, modifications, and variations that fall within the scope of the appended claims. Furthermore, the preceding description is not meant to limit the scope of the invention. Rather, the scope of the invention is to be determined by the appended claims and their equivalents.

What is claimed is:

1. A device for creating hydrodynamic cavitation in fluid, the device comprising:

a first fluid passage having a longitudinal axis and defined by at least one wall having an inner surface;

a second fluid passage disposed within the first fluid passage and defined by at least one wall having an inner surface, the at least one wall that defines the second fluid passage includes a first baffle extending outward therefrom, thereby defining a first orifice between the first baffle and the at least one wall that defines the first fluid passage, the first orifice configured to generate a first hydrodynamic cavitation field downstream therefrom, wherein the at least one wall that defines the second fluid passage includes one or more openings to permit fluid to flow from within the first fluid passage to within the second fluid passage or vice versa;

a second baffle disposed within the second fluid passage and spaced from the inner surface of the at least one wall that defines the second fluid passage, thereby defining a second orifice between the second baffle and the at least one wall that defines the second fluid passage, the second orifice configured to generate a second hydrodynamic cavitation field downstream therefrom.

2. The device of claim 1, wherein the openings are circular, slotted, or meshed.

3. The device of claim 1, wherein the first and second orifices are annular shaped.

4. The device of claim 1, wherein the first and second orifices are concentrically arranged within the first fluid passage.

5. The device of claim 1, wherein the first and second baffles both lie in a plane that is substantially perpendicular to the longitudinal axis of the first fluid passage.

6. The device of claim 1, wherein the first orifice has a first gap thickness defined as the radial distance between the first baffle and the inner surface of the at least one wall that defines the first fluid passage, and the second orifice has a second gap thickness defined as the radial distance between the second baffle and the inner surface of the at least one wall that defines the second fluid passage.

7. The device of claim 6, wherein the first gap thickness is substantially equal to the second gap thickness.

8. The device of claim 6, wherein the first gap thickness is different than the second gap thickness.

9. The device of claim 1, wherein at least one of the first and second baffles includes a cylindrical surface and a tapered surface that confronts fluid flow.

10. A device for creating hydrodynamic cavitation in fluid, the device comprising:

(a) an inlet opening for introducing fluid into the device;

(b) an outlet opening for exiting fluid from the device;

(c) a first fluid passage in fluid communication with the inlet opening and the outlet opening, the first fluid passage having:

(i) a first upstream end and a first downstream end;

(ii) a longitudinal axis and being defined by a first wall; and (iii) a first baffle element disposed within the first fluid passage between the first upstream end and the first downstream end, thereby defining a first orifice between the outer-most perimeter of the first baffle element and the inside surface of the first wall, wherein the first baffle element is positioned to generate a hydrodynamic cavitation field downstream from the first baffle element;

(d) a second fluid passage in fluid communication with the inlet opening and the outlet opening, the second fluid passage having:

(i) a second upstream end and a second downstream end;

(ii) a longitudinal axis that is parallel to the longitudinal axis of the first fluid passage, the second fluid passage being defined by the outside surface of the first wall and the inside surface of a second wall, the first wall and the second wall being parallel to each other; and (iii) a second baffle element disposed within the second fluid passage between the second upstream end and the second downstream end, the second baffle element being positioned substantially the same plane as the first baffle element, and the second baffle element being connected to or a part of the outside surface of the first wall, thereby defining a second orifice between the outer-most perimeter of the second baffle element and the inside surface of the second wall, wherein the second baffle element is positioned to generate a hydrodynamic cavitation field downstream from the second baffle element.

11. The device of claim 10, wherein the first wall has one or more openings disposed therein to provide fluid communication between the first fluid passage and the second fluid passage.

12. The device of claim 11, wherein the openings are circular, slotted or meshed.

13. The device of claim 10, wherein the size of the first orifice and the size of the second orifice may be the same or different.

14. The device of claim 13, wherein the size of the first orifice and the size of the second orifice are the same.

15. The device of claim 13, wherein the size of the first orifice and the size of the second orifice are different.

16. The device of claim 10, wherein the first and second wall defining the first and second flow-through chambers are each cylindrically shaped and have a circular cross-section.

17. The device of claim 10, wherein at least one of the first baffle element and the second baffle element is conically shaped and having a tapered portion that confronts fluid flow.

18. The device of claim 10, further comprising:

a third fluid passage in fluid communication with the inlet opening and the outlet opening, the third fluid passage having:

a longitudinal axis that is parallel to the longitudinal axis of the first fluid passage and the longitudinal axis of the second fluid passage, the third fluid passage being defined by the outside surface of the second wall and the inside surface of a third wall, the third wall being parallel to the first wall and the second wall; and a third baffle element disposed within the third fluid passage between a third upstream end and a third downstream end, the third baffle element being positioned in substantially the same plane as the first baffle element and the second baffle element, and the third baffle element being connected to or a part of the outside surface of the second wall, thereby defining a third orifice between the outer-most perimeter of the third baffle element and the inside surface of the third wall, wherein the third baffle element is positioned to generate a hydrodynamic cavitation field downstream from the third baffle element.

* * * * *